US007479071B2

(12) United States Patent
Adams

(10) Patent No.: US 7,479,071 B2
(45) **Date of Patent: *Jan. 20, 2009**

(54) GOLF CLUB HEAD

(75) Inventor: Edwin H. Adams, Santa Maria, CA (US)

(73) Assignee: Adams Golf IP, L.P., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/705,054

(22) Filed: Feb. 12, 2007

(65) Prior Publication Data

US 2007/0142125 A1 Jun. 21, 2007

Related U.S. Application Data

(63) Continuation-in-part of application No. 11/509,706, filed on Aug. 25, 2006.

(60) Provisional application No. 60/710,875, filed on Aug. 25, 2005.

(51) Int. Cl.
*A63B 53/04* (2006.01)

(52) U.S. Cl. ..... 473/345; 473/348

(58) Field of Classification Search ..... None
See application file for complete search history.

(56) References Cited

U.S. PATENT DOCUMENTS

| | | | | |
|---|---|---|---|---|
| 5,753,088 | A * | 5/1998 | Olk | 204/173 |
| 6,364,788 | B1 * | 4/2002 | Helmstetter et al. | 473/324 |
| 6,575,845 | B2 * | 6/2003 | Galloway et al. | 473/329 |
| 2002/0113335 | A1 | 8/2002 | Lobovsky et al. | |
| 2003/0165648 | A1 | 9/2003 | Lobovsky et al. | |
| 2004/0096389 | A1 | 5/2004 | Lobovsky et al. | |
| 2005/0020385 | A1 | 1/2005 | Onoda et al. | |
| 2005/0074569 | A1 | 4/2005 | Lobovsky et al. | |
| 2005/0228140 | A1 | 10/2005 | Rajagopalan et al. | |
| 2005/0245690 | A1 | 11/2005 | Rajagopalan et al. | |
| 2006/0135281 | A1 | 6/2006 | Palumbo et al. | |
| 2006/0160636 | A1 | 7/2006 | Palumbo et al. | |

FOREIGN PATENT DOCUMENTS

| | | |
|---|---|---|
| EP | 0854839 | 4/2002 |

(Continued)

OTHER PUBLICATIONS

Jackson, Jeff. "Standard Loft Specifications," The Mordern Guide to Golf Clubmaking. Ohio: Dynacraft Golf Products, Inc. copyright 1194, p. 237.*

(Continued)

*Primary Examiner*—Eugene Kim
*Assistant Examiner*—Alvin A Hunter
(74) *Attorney, Agent, or Firm*—Welsh & Flaxman LLC

(57) ABSTRACT

A golf club head includes a club head body having a striking face, a soleplate, a toe, a heel and a hosel. The club head body includes a body shell composed of the striking face, soleplate, toe and heel, wherein at least a portion of the body shell is composed of a flexible material having a density of less than approximately 2.5 g/cm$^3$ and tensile strength of at least approximately 465 MPa /(g/cm$^3$) which is secured to a substrate with the flexible material facing an exterior of the club head.

4 Claims, 6 Drawing Sheets

FOREIGN PATENT DOCUMENTS

| | | | |
|---|---|---|---|
| JP | 2001262291 | | 9/2001 |
| JP | 2002000778 | | 1/2002 |
| JP | 2002000778 A | * | 1/2002 |
| JP | 2002085602 | | 3/2002 |
| JP | 2004229869 | | 8/2004 |

OTHER PUBLICATIONS

"Advanced Materials & Composites News", Composites News International, vol. 27, No. 16 of 23, Issue # 614, Aug. 15, 2005 (6 pgs.).

Barry, Patrick L., "The Right Stuff for Super Spaceships", Sep. 16, 2002, pp. 1-7, http://www.brightsurf.com/NASA_news_091602.html.

"Commericalizing Nanocarbon in Japan Part I Interview MEFS Co. Ltd., Prof. M. Endo's Start-up", Asia Pacific Nanotech Weekly, vol. 3, article #5 (2005) (4 pgs.).

"Golfers should relish nanotechnology", Nanotechwire.com, Jan. 6, 2005, http://www.nanotechwire.com/news.asp?nid=1452.

Kramer, Scott, "Golf's Newest Buzzword", PGA Magazine, Nov. 2004 (2 pgs.).

"NanoMatters", ARC Centre for Functional Nanomaterials, Issue 2, May 2005 (4 pgs.).

Ouellette, Jennifer, "Building the Nanofuture with Carbon Tubes", The Industrial Physicist, Dec. 2002/Jan. 2003, pp. 18-21.

Winters, Jeffrey, "Wonder Cloth", Mechanical Engineering, Apr. 2006, pp. 34-35.

Zhang, Mei et al., "Strong, Transparent, Mulitfunctional, Carbon Nanotube Sheets", Science, vol. 309, Aug. 19, 2005, pp. 1215-1219.

Achenbach, James, "For Your Game :Weight Watching", Golfweek, Jun. 8, 2006 (2 pgs.).

* cited by examiner

GOLF CLUB HEAD

CROSS REFERENCE TO RELATED APPLICATIONS

This application is a continuation-in-part of U.S. patent application Ser. No. 11/509,706 entitled "Golf Club Head", filed Aug. 25, 2006, which is currently pending, which claims the benefit of U.S. Provisional Patent Application Ser. No. 60/710,875, entitled "GOLF CLUB HEAD", filed Aug. 25, 2005.

BACKGROUND OF THE INVENTION

1. Field of the Invention

This invention relates to a golf club head. More particularly, the invention relates to a golf club head composed of a lightweight material offering improved strength and enhanced mass positioning within a golf club head.

2. Description of the Related Art

Golf club manufacturers are consistently attempting to design golf clubs that are easier to hit and offer golfers greater forgiveness when the ball is not struck directly upon the sweet spot of the striking face. As those skilled in the art will certainly appreciate, many designs have been developed and proposed for assisting golfers in learning and mastering the very difficult game of golf.

Much of the focus of the golf club heads is on ways to shift the weight within the golf club head in a manner which improves the striking characteristics of the club.

As such, a need exists for an improved golf club head which provides for greater versatility in shifting mass about a golf club head in a manner improving the striking characteristics of the golf club head. The present invention provides such a club head, which also provides a club head exhibiting improved strength characteristics.

SUMMARY OF THE INVENTION

It is, therefore, an object of the present invention to provide a golf club head including a club head body which includes a striking face, a soleplate, a toe, a heel and a hosel. The club head body includes a body shell composed of the striking face, soleplate, toe and heel, wherein at least a portion of the body shell is composed of a flexible material having a density of less than approximately 2.5 g/cm$^3$ and tensile strength of at least approximately 465 MPa /(g/cm$^3$) which is secured to a substrate with the flexible material facing an exterior of the club head.

It is also an object of the present invention to provide a golf club head wherein the flexible material is composed of carbon nanotubes.

It is also another object of the present invention to provide a golf club head wherein the carbon nanotubes are tiny carbon tubes woven into a sheet of a predetermined size.

It is also a further object of the present invention to provide a golf club head wherein the shell includes a crown which is composed of carbon nanotubes.

It is still another object of the present invention to provide a golf club head wherein the club head body has a volume of at least approximately 300 cc.

It is yet another object of the present invention to provide a golf club head wherein the club head body has a mass of approximately 180 g to approximately 250 g, and the body shell has a mass of no more than 150 g.

It is also an object of the present invention to provide a golf club head wherein the soleplate is composed of carbon nanotubes.

It is a further object of the present invention to provide a golf club head wherein the club head is a metal wood type golf club head.

It is still a further object of the present invention to provide a golf club head wherein the striking face has a loft of approximately 7 degrees to approximately 13 degrees.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but as a basis for the claims and for teaching one skilled in the art how to make and/or use the invention.

Figure 1:
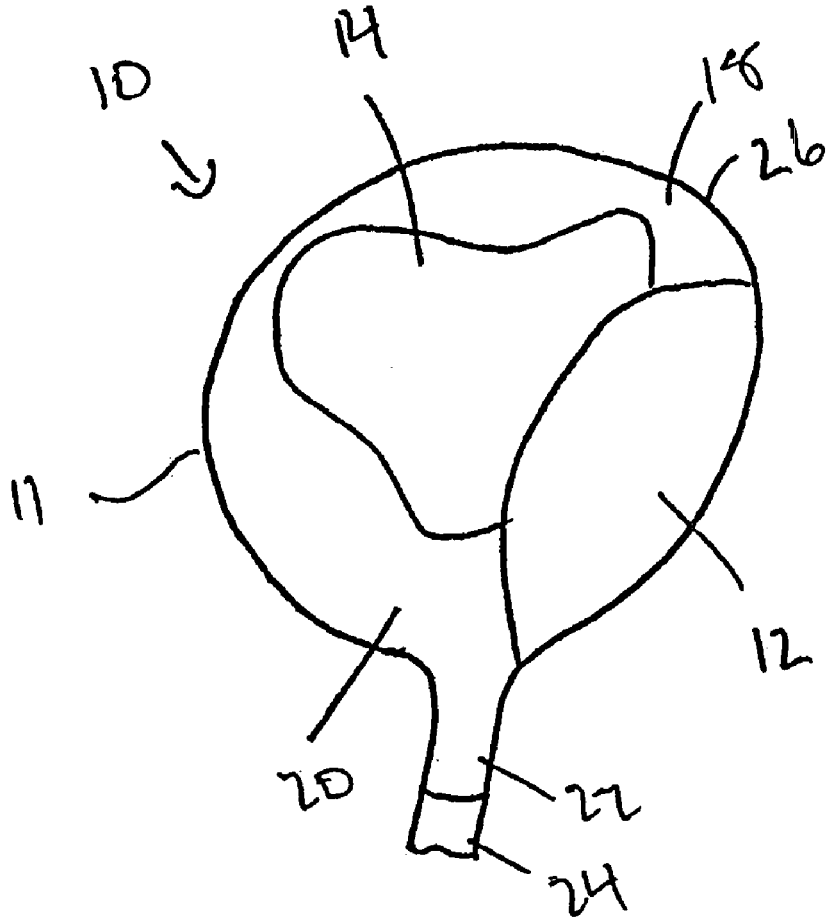
FIG. 1 is a bottom perspective view of a driver type golf club head in accordance with the present invention.
Figure 2:
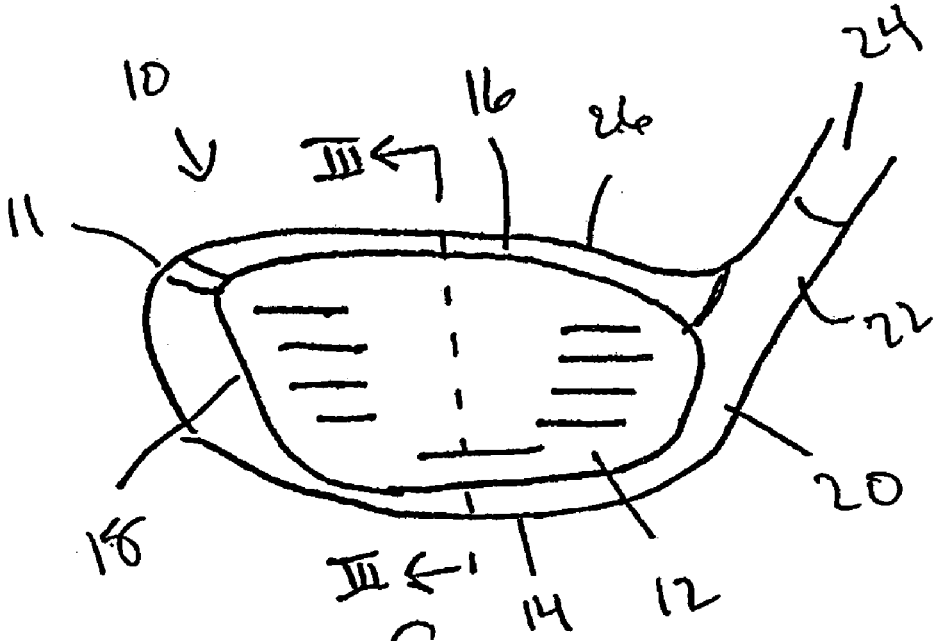
FIG. 2 is a front plan view of the golf club head shown in FIG. 1.
Figure 3:
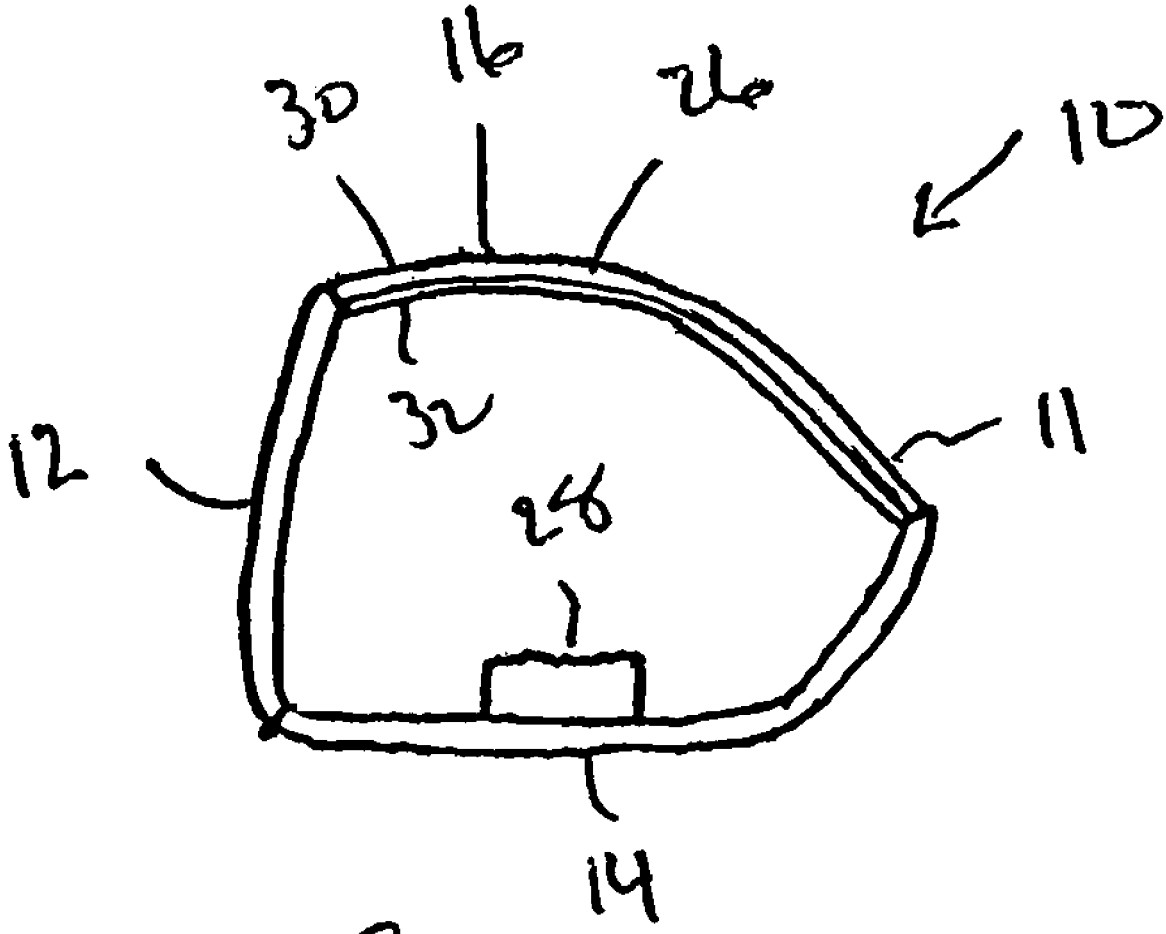
FIG. 3 is a cross-sectional view of the golf club head along the line III-III in FIG. 2.

With reference to FIGS. 1, 2 and 3, a golf club head is shown. The golf club head 10 includes a club head body 11. The club head body 11 includes a striking face 12, a soleplate 14, a crown 16, a toe 18, a heel 20, a skirt 21, or other structure, used in connecting the crown 16 to the soleplate 14, and a hosel 22 to which a golf club shaft 24 is secured, as well as any weight member(s) 28 which might be incorporated into the club head body 11. The club head body 11 includes a body shell 26 composed of the striking face 12, soleplate 14, crown 16, toe 18, heel 20 and skirt 21. That is, the body shell 26 may generally be considered the structure used in striking a golf ball and, as will be discussed below in greater detail, may have various weighting member(s) 28 secured thereto in an effort to optimize the striking characteristics of the golf club head 10. The combination of the hosel 22, weighting member (s) 28 and the body shell 26 generally make up the club head body 11 as discussed herein. While the present metal wood type golf club head, and those which follow, are disclosed as including a skirt, those skilled in the art will appreciate that club heads constructed without a skirt will still be considered to fall within the spirit of the present invention.

In accordance with a preferred embodiment, the golf club head 10 is that of a metal wood type driver, that is, a metal wood driver type golf club head having a striking face 12 with a loft of approximately 7 degrees to approximately 13 degrees. The golf club head 10, and in particular, the club head body 11, has a volume of at least approximately 300 cc as measured along its outer surface and, considering current weight standards applied to golf club heads, has a mass of approximately 180 g to approximately 250 g, preferably approximately 180 g to approximately 220 g, and preferably approximately 200 g.

Although a driver type golf club head is disclosed herein in accordance with a preferred embodiment of the present invention, the concepts underlying the present invention may be applied to a variety of golf club head types, for example, fairway woods, hybrids, irons, etc., without departing from the spirit of the present invention. As discussed below in detail, when these various golf club head types are employed in the spirit of the present invention, the volume and weighting of these golf club heads are varied to suit their differing constructions and the manner in which the weight distribution is manipulated is similar.

In accordance with a preferred embodiment of the present invention, at least a portion of the body shell 26 is composed of a relatively flexible, transparent sheet made from minute carbon nanotubes. The carbon nanotube sheet material 30 is secured to a substantially rigid substrate 32, which is then secured to the remainder of the body shell 26 through the use of adhesive, heat, brazing, welding and/or soldering, or any other known coupling techniques.

The nanotubes are tiny carbon tubes, too small to see with the naked eye, and are woven into an aerogel sheet of a predetermined size; in fact, trillions of tubes are woven into aerogel sheets about two inches wide and three feet long, which then may be used in the manufacture of golf club heads in accordance with the present invention. In accordance with a preferred embodiment, multiple aerogel sheets are layered to produce the densified, highly oriented carbon nanotube sheet material exhibiting desirable characteristics for use in the manufacture of golf club heads. This carbon nanotube sheet material preferably has a thickness of 50 nm and a density of 0.5 g/cm$^3$. In accordance with a preferred embodiment, the carbon nanotube sheet material offers a density of less than approximately 2.5 g/cm$^3$, preferably less than approximately 2.0 g/cm$^3$, and a tensile strength of at least approximately 465 MPa/(g/cm$^3$). Specifics regarding the manufacture and composition of the transparent carbon nanotube sheet material are disclosed by Mei et al. in Science Magazine. Mei Zhang, Shaoli Fang, Anvar A. Zakhidov, Sergey B. Lee, Ali E. Aliev, Christopher D. Williams, Ken R. Atkinson, and Ray H. Baughman, "Strong, Transparent, Multifunctional, Carbon Nanotube Sheets", Science 19 Aug. 2005; 309:1215-1219, which is incorporated herein by reference. Additional information concerning carbon nanotube fabrication is disclosed in U.S. Patent Application Publication Nos. 2002/0113335 to Lobovsky et al., entitled "Spinning, Processing, and Applications of Carbon Nanotube Filaments, Ribbons and Yarns", 2003/0165648 to Lobovsky et al., entitled "Composite Material Comprising Oriented Carbon Nanotubes in a Carbon Matrix and Process for Preparing Same", 2004/0096389 to Lobovsky et al., entitled "Spinning, Processing, and Applications of Carbon Nanotube Filaments, Ribbons and Yarns", and 2005/0074569 to Lobovsky et al., entitled "Composite Material Comprising Oriented Carbon Nanotubes in a Carbon Matrix and Process for Preparing Same", which are also incorporated herein by reference.

The carbon nanotube sheet material 30 described above is a strong and lightweight material. With this in mind, use of the carbon nanotube sheet material 30 offers a great reduction in the weight of the golf club head without sacrificing strength. Although carbon nanotube sheet material is disclosed for use in accordance with various embodiments disclosed herein, those skilled in the art will appreciate other materials offering similar weight and strength, characteristics may be employed without departing from the spirit of the present invention.

As briefly mentioned above, the carbon nanotube sheet material 30 is secured to a substrate 32. In accordance with a preferred embodiment of the present invention, the substrate 32 is a titanium alloy, although other lightweight and strong materials may be used in accordance with a preferred embodiment of the present invention. The substrate 32 is very thin and adds to the stability of the carbon nanotube sheet material 30. In accordance with a preferred embodiment, the titanium alloy substrate 32 will have a minimal thickness. The carbon nanotube sheet material 30 is secured to the substrate 32 such that the carbon nanotube sheet material 30 faces the exterior of the club head 10 so that the strength characteristics of carbon nanotube sheet material may be fully utilized.

Implementation of the carbon nanotube sheet material 30 in conjunction with a thin substrate 32 reduces the mass of the body shell 26 to approximately no more than 150 g. Since the body shell 26 has a mass of no more than 150 g, weight member(s) 28 are attached to the body shell 26 in a manner bringing the golf club head 10 up to a mass commensurate with that of a conventional metal wood driver type golf club head. As such, at least approximately 30 g to 100 g of weight member(s) 28 are available for selective positioning within (or to the outer surface of) the club head body 11 in a manner optimizing the golf club head 10 for specific golf swings.

As those skilled in the art will certainly appreciate, the extra weight member(s) 28 may be positioned at a variety of locations depending upon the swing characteristics of the golfer. For example, the majority of the weight member(s) 28 could be placed on the center of the soleplate 14 to pull the center of gravity as low as possible or they could be positioned around the outer skirt of the golf club head to maximize the moment of inertia. One could also position the weight member(s) on the soleplate, but position it all the way back to increase launch angle while keeping the backspin relatively low (High Launch/Low Spin) or position it all the way forward to control launch angle, lower spin and also lower the amount of gear effect spin caused by off-center hits.

In accordance with a preferred embodiment of the present invention, the crown 16 of the body shell 26 of the club head 10 is composed of the carbon nanotube sheet material/substrate described above, while the remainder of the body shell 26 of the golf club head 10 is composed of a metal, for example, a titanium alloy (although those skilled in the art will appreciate that a variety of materials may be used without departing from the spirit of the invention). The crown 16, composed of the carbon nanotube sheet material 30/substrate 32, is secured across the opening defined by the remainder of the club head body 11. As such, the carbon nanotube sheet material 30/substrate 32 substantially resembles a conventional club head crown when viewed from above, but offers a level of weight and strength previously unknown within the golf industry. By manufacturing the crown 16 of the club head 10 from a high strength, low weight flexible material, and in addition to the reduction in weight discussed above in detail, the flexible carbon nanotube sheet material will function to dampen vibration when the club head 10 strikes a golf ball and will allow an altering of the hitting characteristics of the club head.

Figure 4:
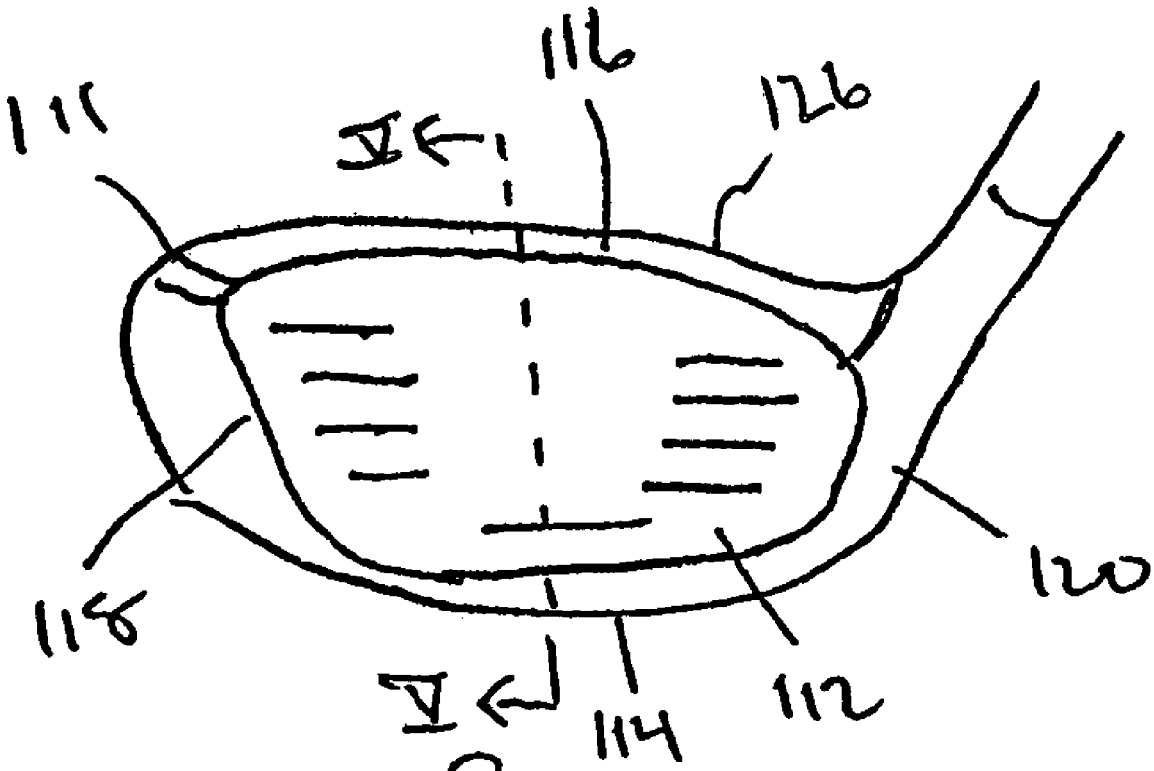
FIG. 4 is a front plan view of a driver type golf club head in accordance with an alternate embodiment.
Figure 5:
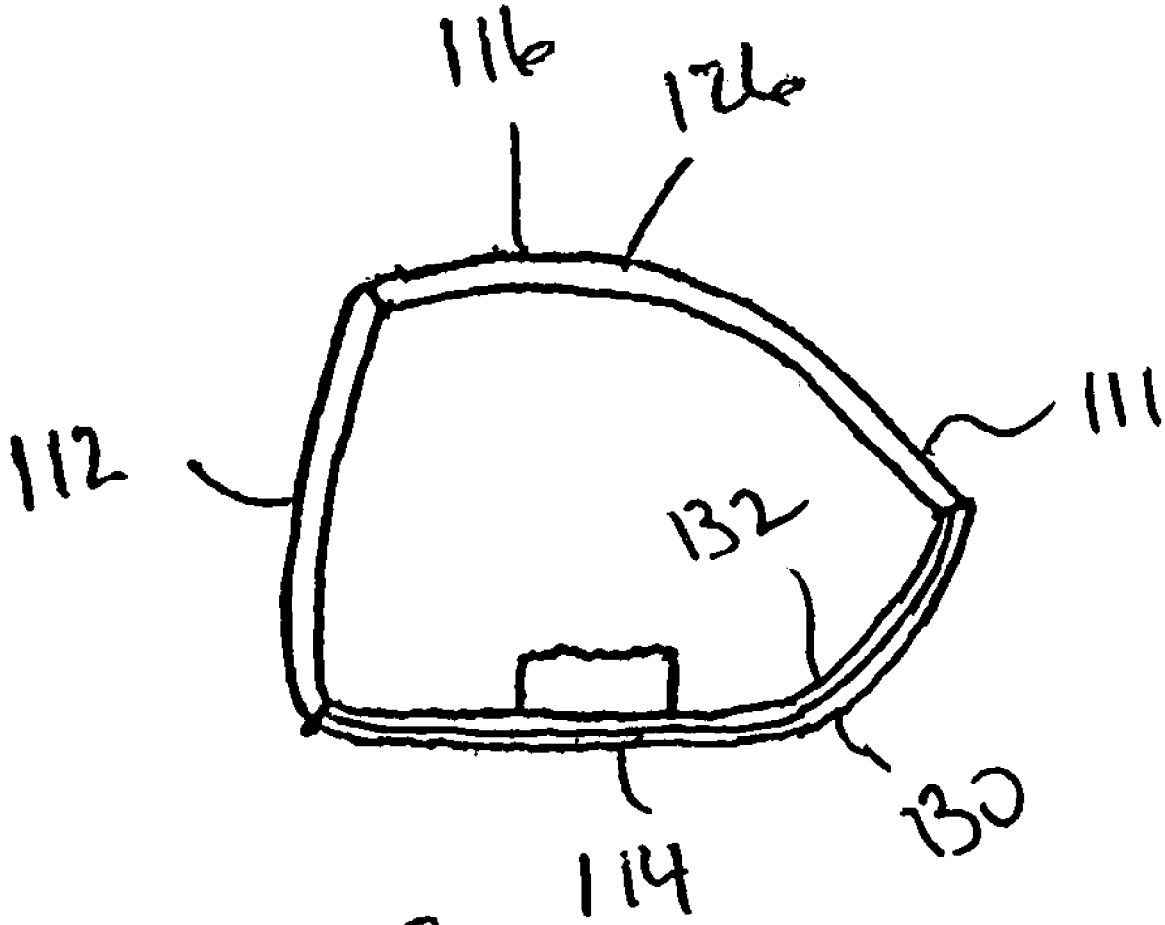
FIG. 5 is a cross-sectional view of the golf club head along the line V-V in FIG. 4.

Similarly, the striking face, soleplate, toe, heel and/or hosel, or combinations thereof, may be formed from the carbon nanotube sheet material. For example, and with reference to FIGS. 4 and 5, it is contemplated, the soleplate 114 might be manufactured from the carbon nanotube sheet material

130/substrate 132 in an effort to provide for enhanced club head strength, while the striking face 112, crown 116, toe 118, heel 120 and skirt 121 of the body shell 126 are composed of traditional golf club head materials. The provision of a lightweight, high strength flexible soleplate 114 changes the hitting characteristics of the striking face 112 and absorbs vibration during a strike of a golf ball. All of these factors work together to provide a golf club head 110 improving the overall performance of the golf club.

Figure 6:
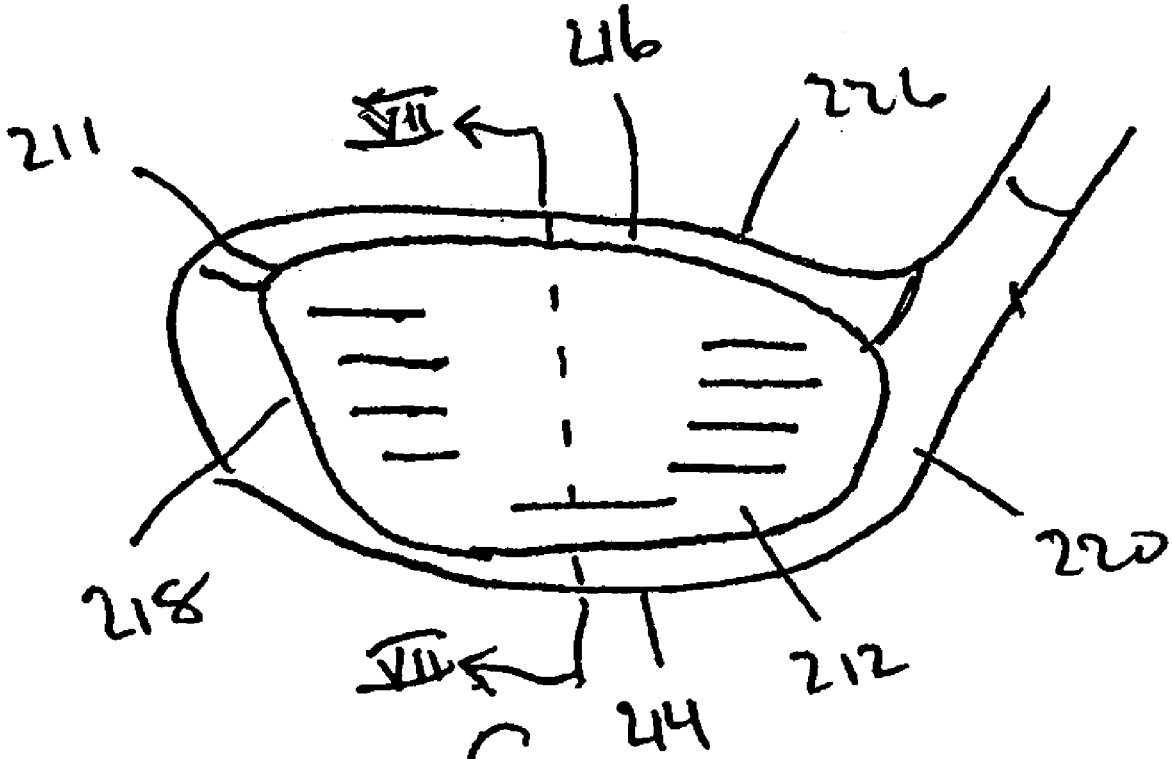
FIG. 6 is a front plan view of a driver type golf club head in accordance with yet another embodiment of the present invention.
Figure 7:
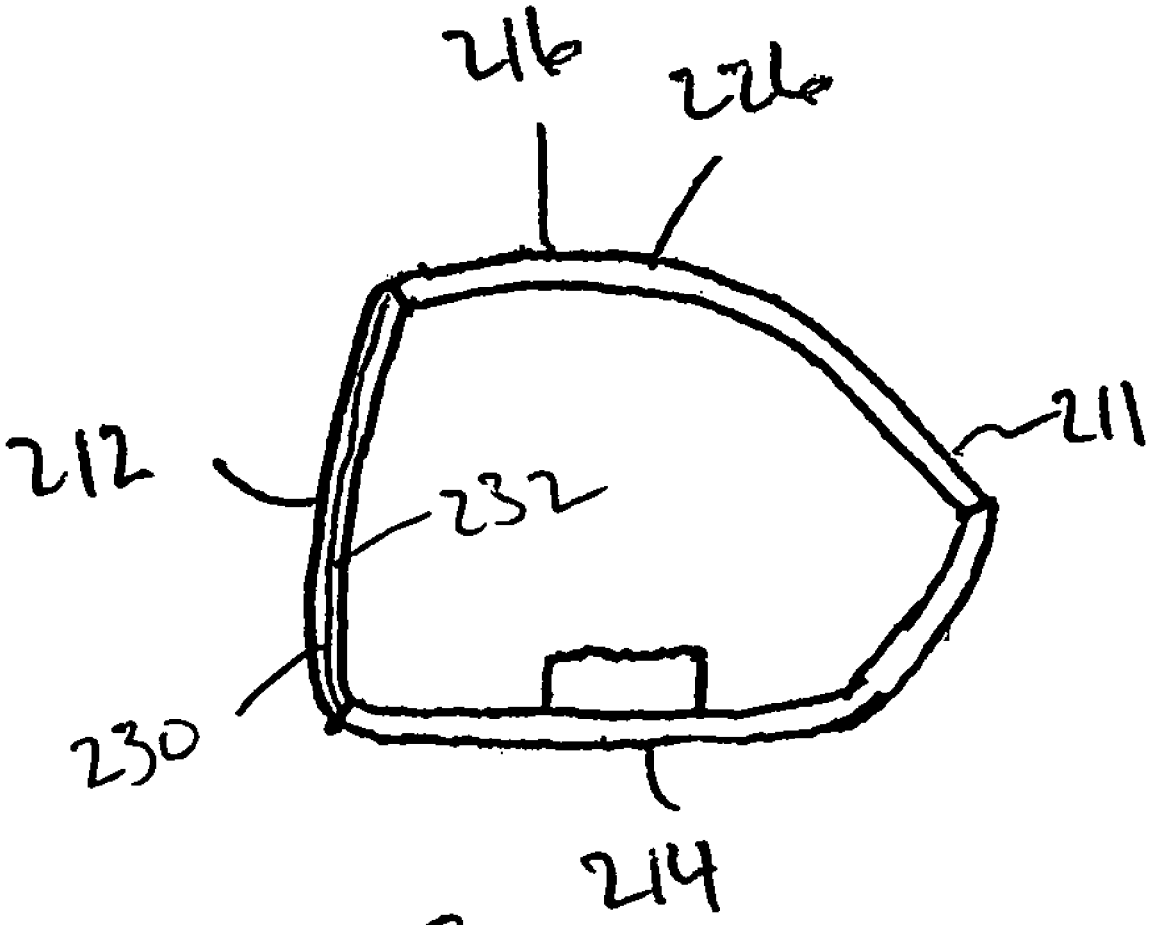
FIG. 7 is a cross-sectional view of a golf club head along the line VII-VII in FIG. 6.

Similarly, the carbon nanotube sheet material 230/substrate 232 might be incorporated into an insert for the striking face 212 (see FIGS. 6 and 7), while the soleplate 214, crown 216, toe 218, heel 220 and skirt 221 are composed of traditional golf club head materials.

It is contemplated the club heads disclosed above in accordance with the various embodiments of the present invention may employ a pressurized internal club head cavity, much as a balloon is pressurized such that it expands to its desired configuration. In accordance with such an embodiment, it is contemplated the internal cavity of the club head body (and body shell) would be pressurized such that ideal hardness characteristics are achieved without the potential for "bursting" of the club head body. The club head would be pressurized with nitrogen gas during the manufacture process and before it is shipped to the consumer. However, it is contemplated the club head may be designed for pressure adjustment by the consumer. A pressurized club head would allow for adjustments (whether made at the factory or at home by the consumer) in the resilience, stability, vibration absorbing characteristics and potentially the look of the club. For example, by adjusting pressure within the club head cavity, the striking face's ability to flex as it comes into contact with the ball during a golf swing may be varied by simply adjusting the degree to which the internal club head cavity is pressurized. A slightly flexible striking face changing the hitting characteristics when struck against a golf ball provides improved moments of inertia and decreased vibration. Similarly, adjustment of the pressure within the internal cavity would allow one to adjust the flex of the soleplate as it comes into contact with the ground.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A golf club head, comprising:

a club head body, the club head body including a striking face, a soleplate, a toe, a heel and a hosel, the club head body having a volume of at least approximately 300 cc and a mass of approximately 180 g to approximately 250 g;

the club head body including a body shell composed of the striking face, soleplate, toe and heel, the body shell having a mass of no more than 150 g, wherein at least a portion of the body shell is composed of a flexible material having a density of less than approximately 2.5 $g/cm^3$ and tensile strength of at least approximately 465 $MPa/(g/cm^3)$ which is secured to a substrate with the flexible material facing an exterior of the club head, the flexible material being composed of carbon nanotubes woven into a sheet of a predetermined size;

wherein the shell further includes a crown which is composed of carbon nanotubes.

2. The golf club head according to claim 1, wherein the soleplate is composed of carbon nanotubes.

3. The golf club head according to claim 1, wherein the club head is a metal wood type golf club head.

4. The golf club head according to claim 1, wherein the striking face has a loft of approximately 7 degrees to approximately 13 degrees.

* * * * *